United States Patent [19]

Lomeli

[11] Patent Number: 4,967,060

[45] Date of Patent: Oct. 30, 1990

[54] FOOTWEAR DRYER ADAPTER FOR USE WITH HAND-HELD BLOW DRYER

[76] Inventor: Richard Lomeli, 798 Vasona, Milpitas, Calif. 95035

[21] Appl. No.: 297,462

[22] Filed: Jan. 13, 1989

[51] Int. Cl.[5] ..... F24H 9/00

[52] U.S. Cl. ..... 392/384; 34/104; 239/391; 239/565; 239/DIG. 21

[58] Field of Search ..... 219/370, 373, 369, 371, 219/367; 34/21, 103, 104, 239; 239/391, 397, 557, 565, DIG. 21

[56] References Cited

U.S. PATENT DOCUMENTS

| | | | |
|---|---|---|---|
| 2,076,735 | 4/1937 | Leindorf | 34/104 |
| 2,614,337 | 10/1952 | Darbo | 34/104 |
| 2,746,799 | 5/1956 | Nelson | 239/565 |
| 3,154,392 | 10/1964 | Littman | 219/373 |
| 3,299,529 | 1/1967 | Roberts et al. | 219/373 |
| 3,645,009 | 2/1972 | Ketchum | 34/104 |
| 3,793,744 | 2/1974 | Saita | 34/104 |
| 3,798,788 | 3/1974 | Kuntz | 34/104 |
| 3,943,329 | 3/1976 | Hlavac | 219/373 |
| 4,094,076 | 6/1978 | Baslow | 219/370 |
| 4,161,955 | 7/1979 | Webb | 219/373 |
| 4,198,765 | 4/1980 | Miyamae | 34/104 |
| 4,596,078 | 6/1986 | McCartney | 34/103 |
| 4,692,594 | 9/1987 | Martin | 219/373 |

*Primary Examiner*—Philip H. Leung
*Assistant Examiner*—Geoffrey S. Evans
*Attorney, Agent, or Firm*—Skjerven, Morrill, MacPherson, Franklin & Friel

[57] ABSTRACT

A drying device includes an adapter portion for fitting over the nozzle of a variety of common hand-held blow dryers and flexible hoses, coupled to the adapter portion and having a plurality of holes, for insertion into footwear, gloves, hats, etc. In one embodiment, the flexible hoses are bent in a U-shape.

8 Claims, 2 Drawing Sheets

FOOTWEAR DRYER ADAPTER FOR USE WITH HAND-HELD BLOW DRYER

BACKGROUND OF THE INVENTION

1. Field of the Invention

This invention relates to drying devices and in particular to a portable drying device for footwear.

2. Description of the Prior Art

Many types of prior art footwear drying devices exist. Of these kinds there are easily portable footwear drying devices and devices which are not intended to be easily transported or to be easily stored in a relatively small space. A further consideration which also distinguishes these prior art devices from one another are their relative costs to manufacture, the bulky and less portable dryers usually being the most expensive.

U.S. Pat. No. 3,798,788 to Kuntz illustrates a bulky and relatively expensive type of boot and glove drying apparatus which is intended for drying a relatively large number of items and not intended to be easily moved. The Kuntz drying apparatus uses a relatively high power heating means specially adapted for use with the drying apparatus and which is integrated into the drying apparatus.

A smaller, more portable, shoe drying apparatus is described in U.S. Pat. No. 4,198,765 to Miyamae. The Miyamae drying apparatus connects a vent, having a plurality of holes, via a flexible tube to a heater unit. The vent is then inserted into a shoe. The heater unit is designed specifically for the Miyamae shoe dryer device, and thus, the cost of the Miyamae device to the consumer includes the price of the specially adapted heater unit. Transporting the Miyamae shoe drying device requires transporting a relatively bulky heating unit whose only function is to dry shoes.

A drying device which uses heated air produced by an existing source, allowing the drying device to be purchased without purchasing a dedicated heating unit, is described in U.S. Pat. No. 4,596,078 to McCartney. This drying device, however, is relatively bulky and cannot be stored in a small space or be easily transported. The vent portion of the Miyamae drying device consists of a plurality of relatively non-flexible hollow protrusions extending out of a main body, each protrusions being provided with a plurality of holes to allow a flow of heated air to enter the article of footwear placed over the protrusion. McCartney suggests using as a heating unit for his drying device a floor mounted heating outlet of a domestic hot air heating system, a hair dryer, or similar source of hot air. It must be assumed that the hair dryer to which Miyamae refers is of the relatively bulky type which is typically placed on a table and includes a flexible hose connected to a plastic cap worn over a person's head. McCartney does not further describe or show an embodiment of this type of drying device which may be used with a hair dryer.

U.S. Pat. No. 3,645,009 to Ketchum describes a more portable type of footwear drying device which is specifically adapted for use with an existing hair dryer. The hair dryer described in Ketchum is of the type which is typically placed on a table and includes a flexible hose for injecting heated air into a plastic cap. The drying device consists of a non-flexible tubing formed in a U-shape and is connected to the flexible hose of the hair dryer. Vent holes are formed in the two legs of the U-shaped tubing so that gloves or boots placed on the ends of the U-shaped tubing will be dried from the inside. The U-shaped tubing is supported on a swivel-type base so that it is oriented vertically. Thus, the Ketchum device provides the highest portability of the previously discussed prior art devices and may be purchased separately from the standard hair dryer heating unit. One of the drawbacks to the Ketchum device, however, is that the non-flexible U-shaped tubing does not conform to the bends of a shoe or a boot and, therefore, the distribution of heat within the shoe is not evenly distributed. Further, the non-flexible tubing cannot be further bent to fit into a luggage or other relatively small space. Another drawback to the Ketchum device is that it requires a relatively bulky hair dryer of the type which is rarely used and owned by the public.

Each of the above-described prior art devices possesses drawbacks regarding portability and cost. Additionally, with the popularity of the hand-held blow dryer, the hair dryer used as the heating unit in the Ketchum and McCartney hair drying devices has been made obsolete. Therefore, the Ketchum and McCartney footwear drying attachments are also obsolete.

SUMMARY OF THE INVENTION

The present invention overcomes all of the previously discussed drawbacks of the prior art including drawbacks relating to transportability, cost, and obsolescence. The present invention comprises a drying device for use with a common hand-held blow dryer. The drying device includes an adapter portion, for fitting over the nozzle of a variety of common hand-held blow dryers, and flexible hoses, coupled to the adapter portion and having a plurality of holes, for insertion into footwear, gloves, hats, etc. In one embodiment, the flexible hoses are bent in a U-shape. The flexibility of the hoses allows each hose to conform to the bends of the shoe or boot, and no support structure is required since, preferably, the shoe or boot is positioned sole-down on the floor. The flexible tubing and adapter are light, inexpensive, and compact. Since the hand-held blow dryer is an item owned by the common consumer and typically taken along on ski trips, etc., the drying device, including blow dryer, requires little additional space in a traveller's luggage.

BRIEF DESCRIPTION OF THE DRAWINGS

Reference will be made to the accompanying drawings which illustrate preferred embodiments of the invention by way of example, and in which.

DETAILED DESCRIPTION

Figure 1:
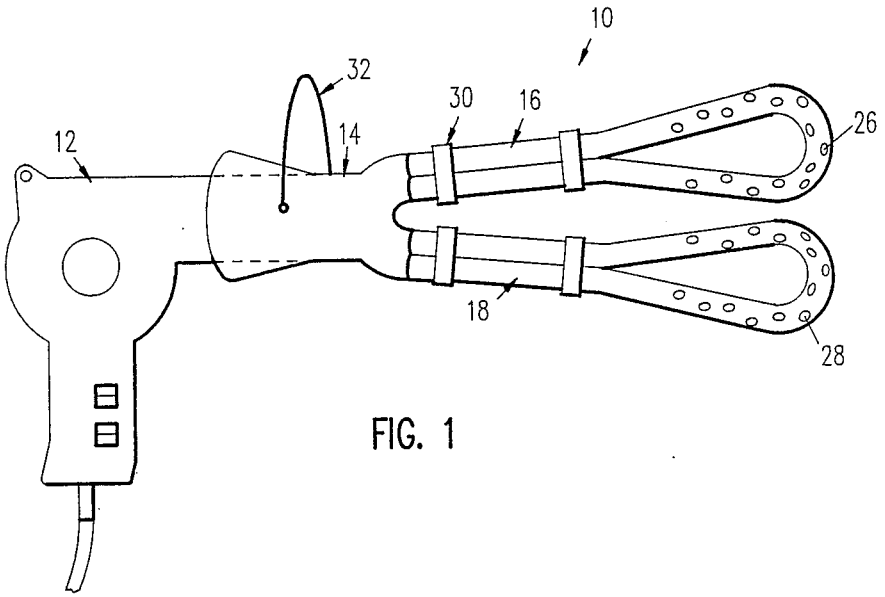
FIG. 1 shows a preferred embodiment of the present invention and further shows a standard hand-held blow dryer inserted into the adapter.

FIG. 1 shows the preferred embodiment of my footwear dryer device 10. Also shown is hand-held blow dryer 12 with its nozzle properly inserted into drying device 10.

Drying device 10 comprises blow dryer adapter 14 and flexible hoses 16 and 18. Blow dryer adapter 14 provides a seal between blow dryer 12 and hoses 16 and 18 so that substantially all air outputted from the nozzle of blow dryer 12 flows into hoses 16 and 18.

Figure 2:
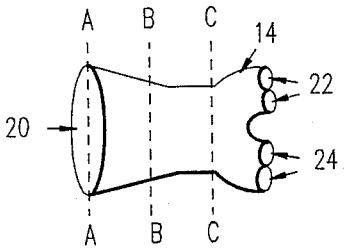
FIG. 2 shows detail of the adapter portion of the invention.

FIG. 2 shows a perspective view of adapter portion 14. Shown in FIG. 2 is opening 20 for receiving the nozzle of a variety of standard hand-held blow dryers. Opening 20 is of a frustum shape to allow a snug fitting for all blow dryers having a circular nozzle with a diameter between approximately 1.5–2.5 inches.

In a preferred embodiment, the diameter of large opening 20 at line A—A is approximately 2.75 inches; the diameter at line B—B is approximately 2 inches; and the diameter at the thinnest portion of adapter 14 at line C—C is approximately 1.5 inches. In this preferred embodiment, the distance between line A—A and line B—B is approximately 1.75 inches, and the distance between line B—B and line C—C is approximately 2.75 inches. This particular shape of adapter 4 in FIG. 2 is well suited to accommodate the maximum number of hand-held blow dryers without causing the length of adapter 14 between lines A—A and C—C to be unduly long.

Further shown in FIG. 2 are openings 22 and 24 for connection of adapter 14 to flexible hoses 16 and 18, shown in FIG. 1. Preferably, holes 22 and 24 are circular and flexible hoses 16 and 18 are of a standard diameter (e.g. 0.5 or 0.75 inches). The diameter of holes 22 and 24 should allow for hoses 16 and 18 to be snugly inserted thereinto.

Referring back to FIG. 1, flexible hoses 16 and 18 have a plurality of holes 26 and 28 in its U-shaped portion to allow heated air to escape therefrom. The legs of flexible hoses 16 and 18 are preferably binded near where the hoses exit from adapter 14 by binding means 30 to provide hoses 16 and 18 with their desired shape. Binding means 30 may be a standard plastic tape. The resulting U-shape of flexible hoses 16 and 18 should enable the hoses to fit loosely within an average size shoe or boot. The length of hoses 16 and 18 where holes 26 and 28 are present should be long enough to dry the entire shoe or boot. Since hoses 16 and 18 are flexible, hoses 16 and 18 may even be inserted into a small child's shoe.

In a preferred embodiment, the diameter of each of holes 26 and 28 are approximately 0.25 inches and are spaced around the U-shaped portion of flexible hoses 16 and 18 so that there are approximately four holes per inch of hose.

For operation, footwear drying device 10 should actually be rotated 90° from that shown in FIG. 1. To use the device, the U-shape sections of hoses 16 and 18 are inserted into wet shoes or boots. The shoes should be positioned sole-down on the floor so that the base of the handle of blow dryer 12 is supporting blow dryer 12 in its upright position. This enables an adequate supply of air to be provided to the air intake vent of blow dryer 12. If boots are to be dried, the boots should also be positioned sole-down on the floor and hoses 16 and 18 inserted into the boot until U-shaped portions of hoses 16 and 18 have bent and occupy the farthest portion of the boot near the toe. In this case, blow dryer 12 will be held vertically by footwear drying device 10. Moisture from the shoe or boot is allowed to escape through the opening of the shoe or boot, and moisture on the outer surface of the shoe or boot will be evaporated into the atmosphere by the heat inside the shoe or boot.

An advantage of drying device 10 further includes, due to the U-shape of flexible hoses 16 and 18, the ability to inject heated air more evenly in the shoe and especially in those areas at the interface of the sole and shoe leather around the perimeter of the shoe, which is most likely to be the wettest. This is accomplished with the flexible U-shape hose having a plurality of holes conforming to the inside curvature of the shoe or boot and thus forcing hot air directly at those portions of the shoe which are typically the most wet.

Also shown in FIG. 1 is elastic strap 32 which may be stretched around adapter portion 14 in order to ensure that the nozzle of blow dryer 12 fits snugly into the opening of adapter 14.

Although the embodiment of FIGS. 1 and 2 can only accommodate two flexible hoses, the drying device can also be easily modified to accommodate four or more flexible hoses. Additionally, hoses 16 and 18 in FIG. 1 may each be a single length of hose, not U-shaped, with a plurality of holes in their end portions. However, this does not provide as uniform an air circulation as the U-shaped portions shown in FIG. 1. Further, adapter portion 14 and hoses 16 and 18 may be made in one unit.

Figure 3:
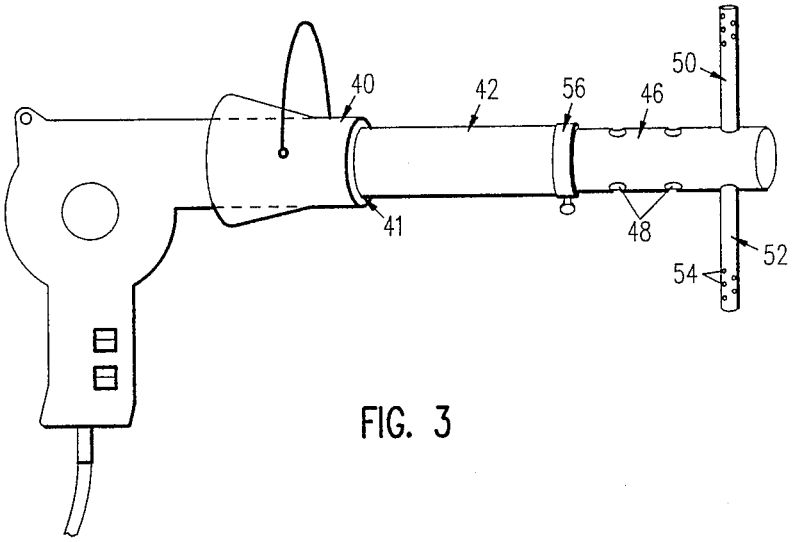
FIG. 3 shows a second embodiment of the invention which increases the number of shoes or boots which may be dried concurrently.

Shown in FIG. 3 is a second embodiment of the invention which has the capability of drying more than two shoes or two boots without wasting heated air through an unused port. In FIG. 3, adapter portion 40 is similar to adapter portion 14 in FIG. 1 except that adapter portion 40 is configured to accept only a single hose 42 fitted into its end opening 41. Preferably, hose 42 is relatively wide (e.g., approximately 2 inches) so that air flow may be unimpeded by the diameter of the hose.

Slideably inserted into hose 42 is slideable hose portion 46. Slideable hose portion 46 has a plurality of holes 48 arranged throughout, wherein these holes accept additional flexible hoses illustratively shown as extension hoses 50 and 52 also containing a plurality of holes 54. Flexible extension hoses 50 and 52 are inserted into a shoe or boot similarly to that described with respect to FIG. 1.

Slideable hose portion 46 is slid into hose portion 42 a sufficient length to prevent air escaping from the holes 48 which are not connected to an extension hose. The end of slideable hose portion 46 is blocked so as to prevent air from escaping. Hose 42 and slideable hose portion 46 may be formed of a semi-flexible material, such as PVC tubing.

The embodiment of FIG. 3 allows the drying device to be compact for storage and later expanded to dry a relatively large number of shoes.

In one embodiment, clamping means 56, which can be tightened by hand, is provided to enable an airtight seal between hose portion 42 and slideable hose portion 46.

Figure 4:
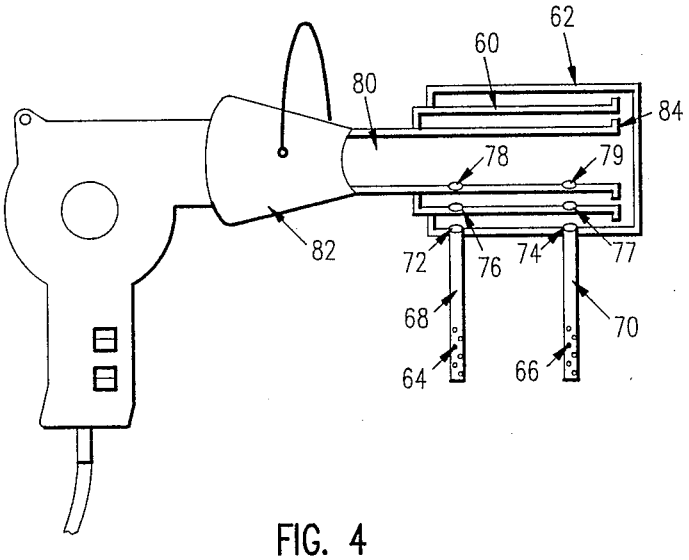
FIG. 4 shows a partial cross-section of a third embodiment of the invention.

Shown in FIG. 4 is a partial cross-section of a third embodiment of the invention, similar in concept to the embodiment of FIG. 3. In the drying device of FIG. 4, two slideable hose portions 60 and 62 may be extended if more than two shoes are desired to be dried concurrently. In its compact state, shown in FIG. 4, the device allows two shoes to be dried by heated air being forced through holes 64 and 66 in flexible hose portions 68 and 70, respectively.

Flexible hose portions 68 and 70 are inserted through holes 72 and 74 in slideable hose portion 62.

Holes 76, 77, 78, and 79 formed in slideable hose portion 60 and fixed hose portion 80 are aligned with holes 72 and 74 so that heated air may flow unimpeded into flexible hose portions 68 and 70.

Adapter portion 82 is similar to adapter portion 14 in FIG. 1 and is connected to fixed hose portion 80.

To dry four or six shoes concurrently, slideable hose portions 60 and 62 are extended as necessary to expose holes 76, 77, 78, and 79 for insertion thereinto of additional flexible hoes, similar to flexible hose portions 68 and 70, having a plurality of holes therein.

The ends of fixed hose portion 80 and slideable hose portion 60 are open to allow heated air to flow through the extended length of the drying device. The end of slideable hose portion 62 is blocked.

Stops 84 prevent slideable portions 60 and 62 from being inadvertently overextended and provide an additional air seal between the various hose portions.

In a preferred embodiment of FIG. 4, the lengths of slideable hose portions 60 and 62 are between 9 to 12 inches, and the distance between holes in each of the hose portions is between 5 to 7 inches to allow sufficient separation of flexible hose portions 68 and 70.

Additional embodiments may include any number of slideable hose portions. Hose portions 60, 62, and 80 may be formed of a semi-flexible material such as PVC tubing.

Thus, the embodiment of FIG. 4 provides a very compact and portable structure for drying footwear.

The specific embodiments herein described are only illustrative of the invention. Other embodiments, including one-piece construction, slightly different shaped flexible tubes, etc. are also encompassed by the invention. Various other changes in structure may additionally occur to those skilled in the art, and all of these changes are to be understood as forming a part of the invention insofar as they fall within the true spirit and scope of the following claims.

I claim:

1. A drying device for use with a hand-held blow dryer comprising:

an adapter portion having an air inlet opening and at least one air outlet opening, said air inlet opening being frustum shaped so as to accept insertion of an air outlet nozzle of a hand-held blow dryer and provide a snug fit between said nozzle and said adapter portion; and at least one flexible hose connected to receive air from said at least one air outlet opening of said adapter portion,said flexible hose having a plurality of holes to allow passage of air therethrough, wherein said at least one flexible hose is bent in a U-shape, and terminal portions of said U-shaped flexible hose are connected to receive air from said at least one air outlet opening of said adapter portion.

2. The drying device of claim 1 wherein said at least one flexible hose comprises two flexible hoses.

3. The drying device of claim 2 wherein said flexible hoses are bent in a U-shape, and terminal portions of said U-shaped flexible hoses are connected to receive air from four of said air outlet openings of said adapter portion.

4. The drying device of claim 1 wherein said adapter portion has an air inlet opening having a maximum diameter of between 2 and 3 inches, said frustum shaped air inlet opening tapering to a diameter of between 1.5 and 2 inches.

5. The drying device of claim 4 wherein said at least one flexible hose and said at least one air outlet opening has a diameter of between 0.5 and 1.0 inches.

6. A drying device adapter for use with a hand-held blow dryer comprising:

an adapter portion having an air inlet opening and an air outlet opening, said air inlet opening being frustum shaped so as to accept insertion of an air outlet nozzle of a hand-held blow dryer and provide a snug fit between said nozzle and said adapter portion;

a first hose portion connected to receive air from said air outlet opening of said adapter portion;

a second hose portion inserted in an end of said first hose portion and slideable with respect to said first hose portion, said second hose portion having a plurality of holes to allow passage of air therethrough; and at least one flexible extension hose portion for connection to receive air from an associated one of said plurality of holes in said second hose portion, said at least one extension hose portion having a plurality of holes to allow passage of air therethrough.

7. A drying device comprising:

a hand-held blow dryer having an air outlet nozzle;

an adapter portion having an air inlet opening and an air outlet opening, said air inlet opening being frustum shaped so as to accept insertion of said air outlet nozzle of said hand-held blow dryer and provide a snug fit between said nozzle and said adapter portion;

a first hose portion connected to receive air from said air outlet opening of said adapter portion;

a second hose portion slideably connected within said first hose portion, said second hose portion having a plurality of holes to allow passage of air therethrough; and at least one flexible extension hose portion for connection to receive air from an associated one of said plurality of holes in said second hose portion, said at least one extension hose portion having a plurality of holes to allow passage of air therethrough.

8. A drying device adapter for use with a hand-held blow dryer comprising:

an adapter portion having an air inlet opening and an air outlet opening, said air inlet opening being frustum shaped so as to accept insertion of an air outlet nozzle of a hand-held blow dryer and provide a snug fit between said nozzle and said adapter portion;

a first hose portion connected to receive air from said air outlet opening of said adapter portion, said first hose portion having a plurality of holes to allow passage of air therethrough;

at least one slideable hose portion axially slideable with respect to said first hose portion, said at least one slideable hose portion having a plurality of holes to allow passage of air therethrough; and at least one flexible extension hose portion for connection to receive air from any one of said plurality of holes in said first hose portion and in said at least one slideable hose portion, said at least one extension hose portion having a plurality of holes to allow passage of air therethrough.

* * * * *